US005752585A

United States Patent [19]

Bittar et al.

[11] Patent Number: 5,752,585

[45] Date of Patent: May 19, 1998

[54] ELEVATOR SHUTTLE WITH AUXILIARY ELEVATORS AT TERMINALS

[75] Inventors: Joseph Bittar, Avon; Anthony Cooney, Unionville; Richard C. McCarthy, Simsbury; Frederick H. Barker, Bristol; Bruce A. Powell, Canton; Samuel C. Wan, Simsbury; Paul Bennett, Waterbury; LucyMary Salmon, South Windsor, all of Conn.

[73] Assignee: Otis Elevator Company, Farmington, Conn.

[21] Appl. No.: 686,992

[22] Filed: Jul. 25, 1996

[51] Int. Cl.[6] ..... B66B 9/00

[52] U.S. Cl. ..... 187/249

[58] Field of Search ..... 187/249

[56] References Cited

U.S. PATENT DOCUMENTS 1,939,729 1/1933 Stark ..... 187/249

5,090,515 2/1992 Takahashi ..... 187/249

OTHER PUBLICATIONS

Strackosch, G.R.; "Vertical Transportation: Elevators and Escalators"; pp. 472–475; New York: 1983.

*Primary Examiner*—Joseph E. Valenza
*Assistant Examiner*—Wonki Park

[57] ABSTRACT

Elevator cabs A–C move upwardly through three or more contiguous overlapping hoistways 38–40 in the upper decks of double deck car frames 41–43, and move downwardly through the hoistways in the lower decks (or vice versa). To switch between decks, the cabs are offloaded from the hoistways into auxiliary elevators 50, 51 at the terminal ends of the shuttle, and are moved to be adjacent to the other deck by the auxiliary elevator and loaded thereon for the trip in the opposite direction. A second embodiment has additional auxiliary elevators 64, 65 and additional cabs D, E so that loading and unloading of passengers do not delay movement of the cabs in the hoistways.

8 Claims, 7 Drawing Sheets

A
B
C
51
53
SKY
54
55
44
43
HI
40
37
UPR
44
LWR
45
MID
39
42
LO
38
41
45
50
GND
52
56
57

A
B
C
D
51
53
SKY
43
HI
40
MED
60
59
61
MID
39
42
LO
38
41
50
GND
52

51
53
SKY
43
HI
40
MED
60
59
61
42
MID
39
LO
38
50
GND
52
41
A
B
C
D

53
SKY
67
66
HI
40a
MED
60
42
MID
39
LO
38a
41
64
66
67
GND
52
50
68
61
43
51
A
B
C
D
E
F

53
SKY
51
65
67
66
HI
40a
43
61
MED
60
59a
MID
39
41
42
LO
38a
50
GND
52
64
66
67
68
53
SKY
GND
52
A
B
C
D
E
F

ELEVATOR SHUTTLE WITH AUXILIARY ELEVATORS AT TERMINALS

TECHNICAL FIELD

This invention relates to elevator shuttles which consist of three or more overlapping, contiguous elevator shafts, each having a double deck car frame moveable between the ends of the corresponding hoistway, elevator cabs being transferred between the various car frames so as to have a cab traveling upwardly or downwardly in each hoistway most of the time, and utilizing auxiliary elevators at terminal levels to transfer cabs between upper and lower decks of the car frames that reach the terminal levels.

BACKGROUND ART

Since all of the passengers for upper floors of a building must travel upwardly through the lower floors of the building, very tall buildings require effective use of elevator hoistways (referred to herein as the "core" of the building). In a commonly owned U.S. patent application Ser. No. 08/564,703, filed on Nov. 29, 1995, an elevator shuttle includes overlapping elevator hoistways, each having a double deck car frame therein. A cab traveling in one direction (up, down) is transferred from the lower deck of one elevator car frame to the lower deck of the other car frame, simultaneously with transferring a cab traveling in the opposite direction (down, up) from the upper deck of the other car frame to the upper deck of the one car frame. However, while that provides for a cab moving in each hoistway at all times so long as there are only two overlapping hoistways, it is impossible to have cabs moving in three or more hoistways at one time in such a system. In a three-hoistway system of said application, either the uppermost or the lowermost one of three hoistways has an empty car frame waiting for a cab. In other words, only two of the three hoistways are carrying passengers at any given time.

DISCLOSURE OF INVENTION

Objects of the invention include provision of three or more overlapping, contiguous elevator hoistways having double deck car frames between which elevator cabs are transferred, with cabs traveling in each hoistway most of the time.

According to the present invention, all elevator cabs traveling upwardly travel on the lower decks of double deck car frames in successive elevator hoistways, and all elevator cabs traveling downwardly travel on the upper decks of the elevator car frames (or vice versa). In accordance with the invention, at each terminal level (such as the ground level and a sky level), the elevator cab is removed from the double deck car frame, the passengers are allowed to exit, the elevator cab is either raised or lowered so as to be adjacent to the other deck of the elevator car frame, passengers allowed to enter, and the elevator cab is reloaded onto the other deck of the car frame. In accordance with the second embodiment of the invention, as one elevator cab is traveling to or from a terminal level of a main hoistway of the shuttle, another elevator cab is being moved upwardly or downwardly in one of two auxiliary elevators at that terminal level; the two cabs are exchanged substantially simultaneously each time a main hoistway elevator car frame reaches a terminal level.

According to the present invention, a shuttle elevator having three or more overlapping, contiguous hoistways, each with a double deck car frame moveable therein, includes auxiliary elevator car frames at the extreme ends of the shuttle (the terminal levels thereof) so as to exchange cabs between the upper and lower decks of the car frames that reach the terminal levels. In one embodiment, there is a single auxiliary elevator at each terminal level. In another embodiment, there are two auxiliary elevators at each terminal level, whereby movement within the main shuttle hoistways is not delayed by movement of the cabs outside the main hoistways.

Other objects, features and advantages of the present invention will become more apparent in the light of the following detailed description of exemplary embodiments thereof, as illustrated in the accompanying drawing.

BEST MODE FOR CARRYING OUT THE INVENTION

Figures 1, 2, 3, 4, 5:
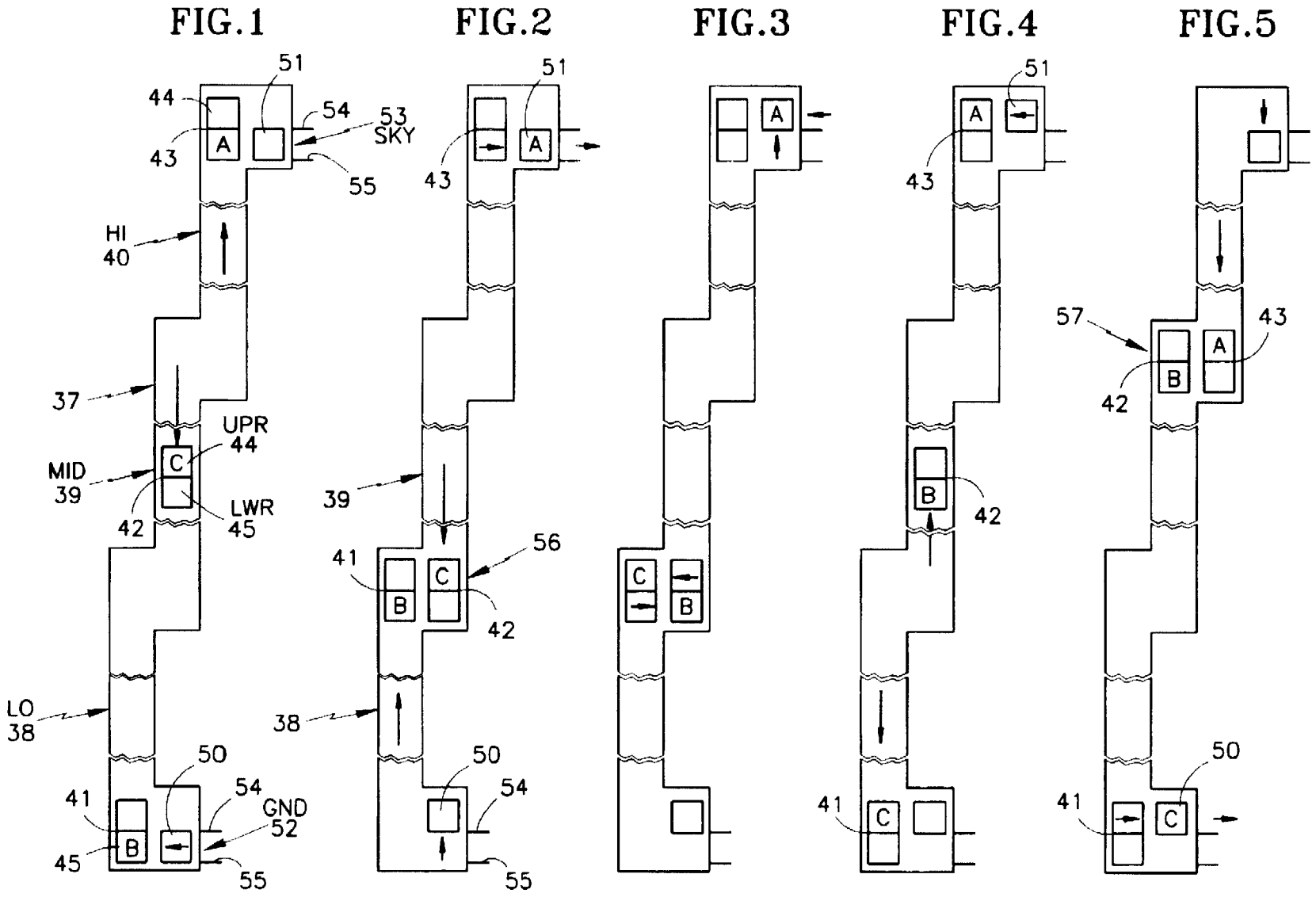
FIGS. 1–10 are stylized, schematic side elevation views of an elevator shuttle including three main hoistways and two auxiliary elevators in accordance with the invention.

Referring now to FIG. 1, an elevator shuttle 37 comprises a low hoistway 38, a mid hoistway 39 and a high hoistway 40 which overlap each other and are contiguous, so that three elevator cabs A–C can be readily transferred therebetween. Each of the hoistways 38–40 has a double deck elevator car frame 41–43 moveable vertically between the ends of the corresponding hoistway. Each car frame 41–43 has an upper deck 44 and a lower deck 45. In the embodiments herein, the cabs ride upwardly on the lower decks 45 and ride downwardly on the upper decks 44, in each instance. Of course, the invention will work equally well with all cars riding upwardly on the upper decks and riding downwardly on the lower decks, which is irrelevant to the present invention.

In order to permit the cabs to uniformly ride in one direction on one deck and in the other direction on the other deck, auxiliary elevators 50, 51 are provided at the ground terminal level 52 and at the sky terminal level 53. Each of these levels have upper and lower landings 54, 55. As seen in FIG. 1, the elevator cab B has just been moved to the left from the auxiliary elevator 50 to the car lower deck of the frame 41; the car frame 43 has just reached the sky level 53 with cab A in its lower deck; and the car frame 42 is being lowered in the mid hoistway 39 with the cab C in its upper deck. Then, in FIG. 2, the car frame 41 moves to the top of the low hoistway 38 as the car frame 42 reaches the bottom of the mid hoistway 39, adjacent to the car frame 41 at a first transfer level 56. During this same period of time, the cab A is moved to the right from the lower deck of the car frame 43 to the upper auxiliary elevator 51, and the doors are opened to allow passengers to egress from the cab A. Also during this same time, the auxiliary elevator 50 has its car frame raised from the lower landing 55 to the upper landing 54 of the ground level 52.

As see in FIG. 3, next to occur is that the cabs C and B are exchanged, and cab A is raised from the lower landing to the upper landing of the upper level, and passengers are allowed to enter cab A. It is possible that time could be saved by allowing passengers to enter at the lower level, but it is believed that passengers should have a minimum of movement, starting and stopping while inside the cabs. If desired, the cab could allow passengers to both exit and enter at either the lower level or the upper level, which is irrelevant to the present invention.

Figure 10:
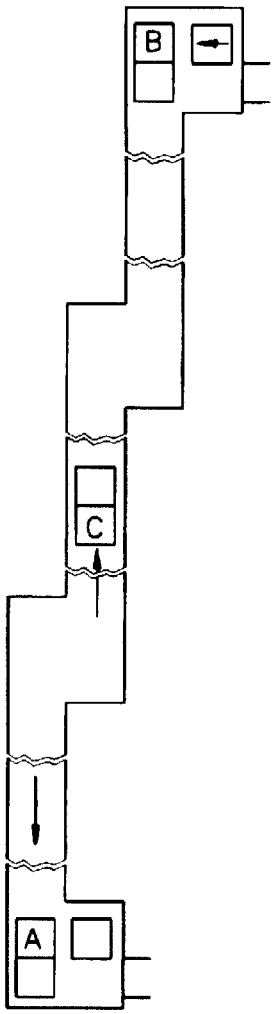
Figure 9:
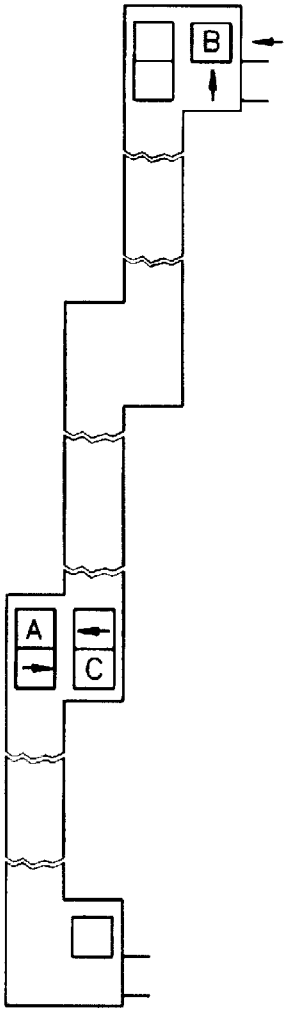
Figure 8:
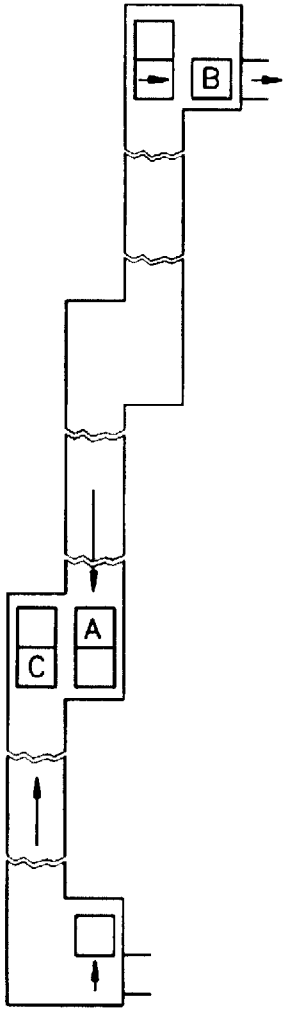
Figure 7:
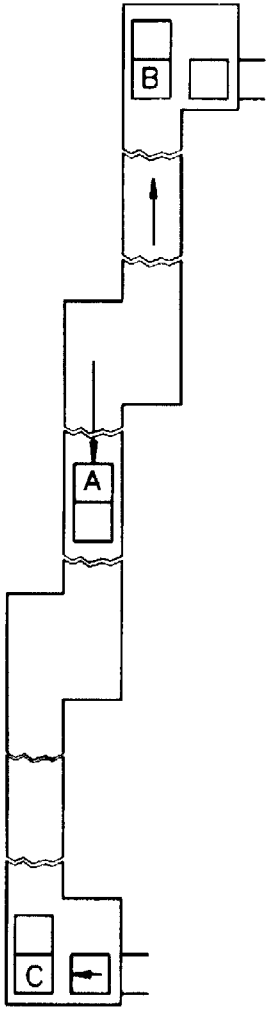
Figure 6:
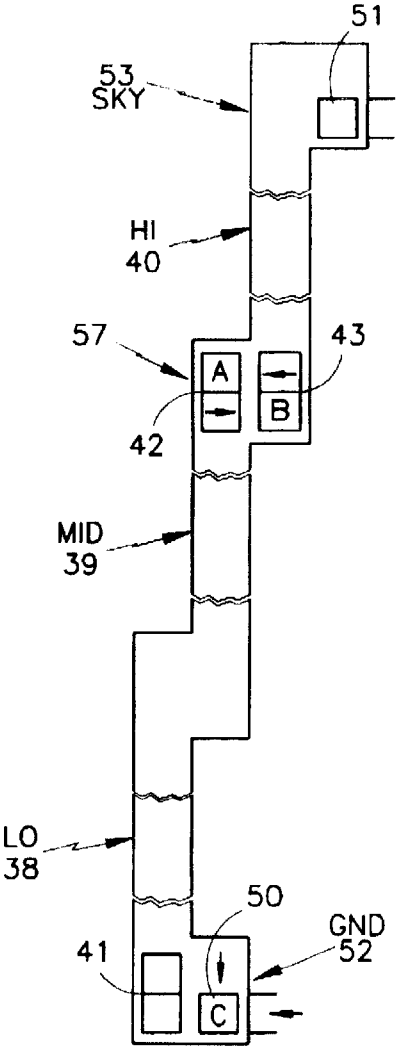
Figures 11, 12, 13, 14, 15:
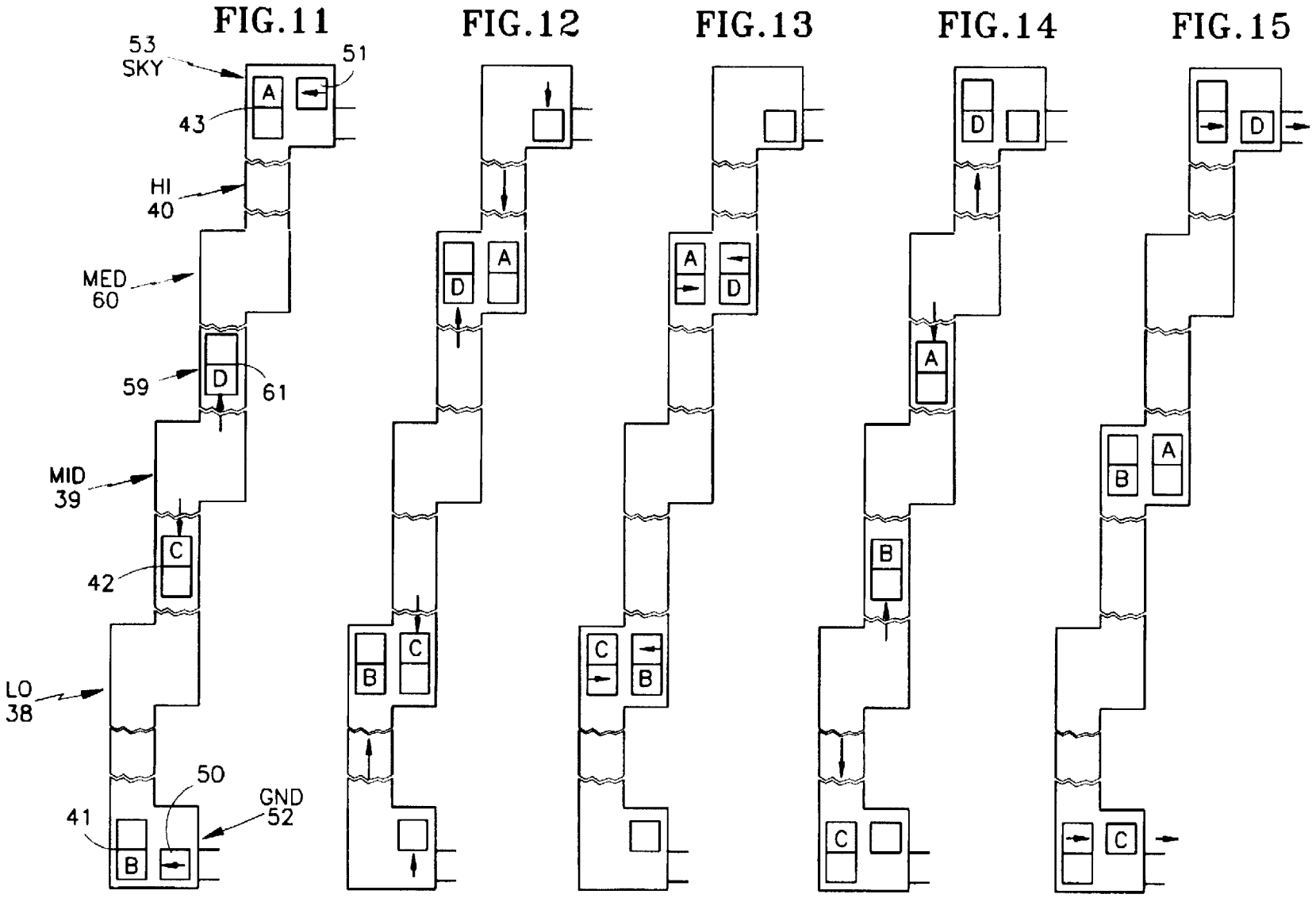
FIGS. 11–20 are stylized, schematic side elevation views of an elevator shuttle including four main hoistways and two auxiliary elevators in accordance with the invention.
Figures 16, 17, 18, 19, 20:
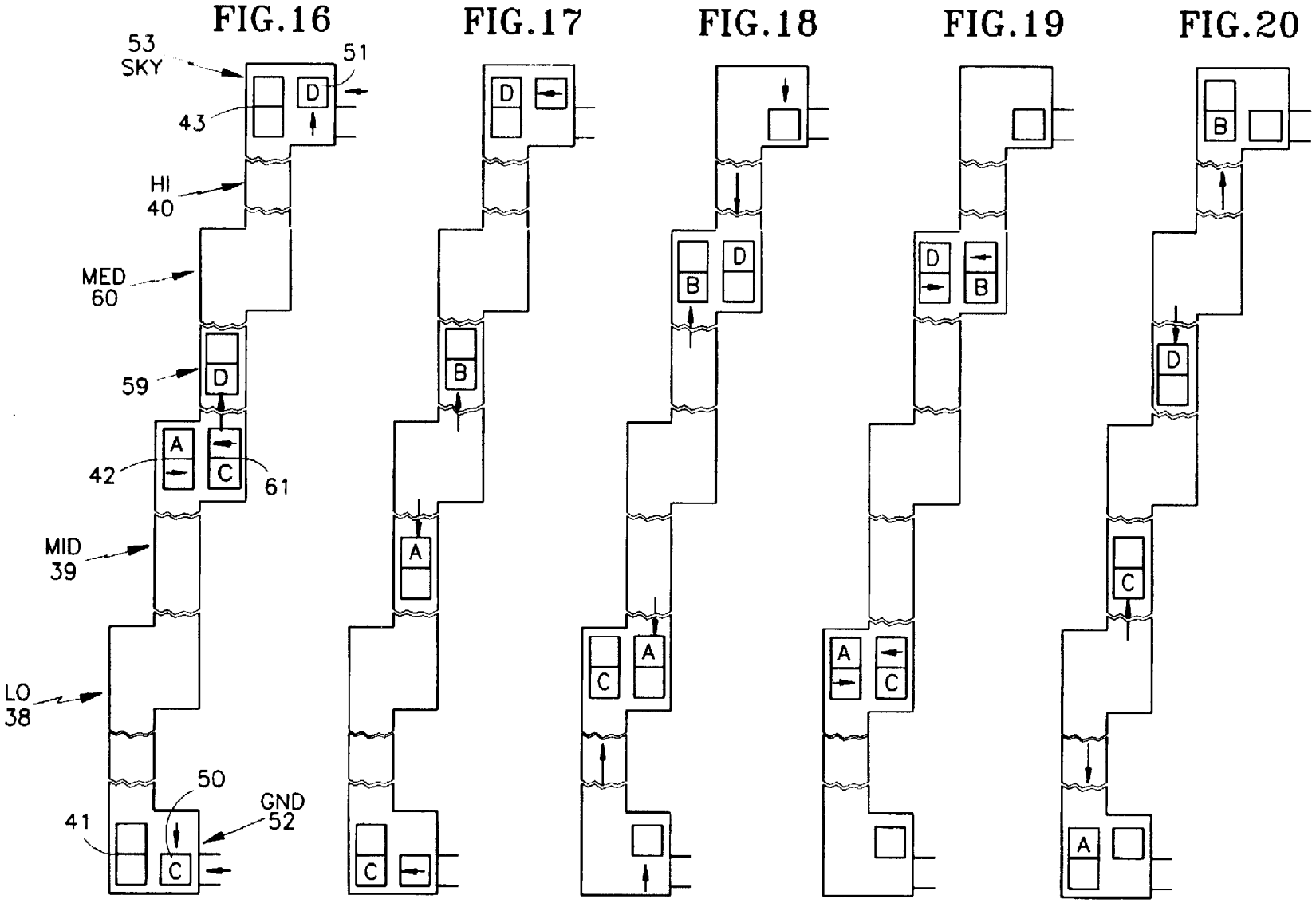
Figures 21, 22, 23, 24, 25:
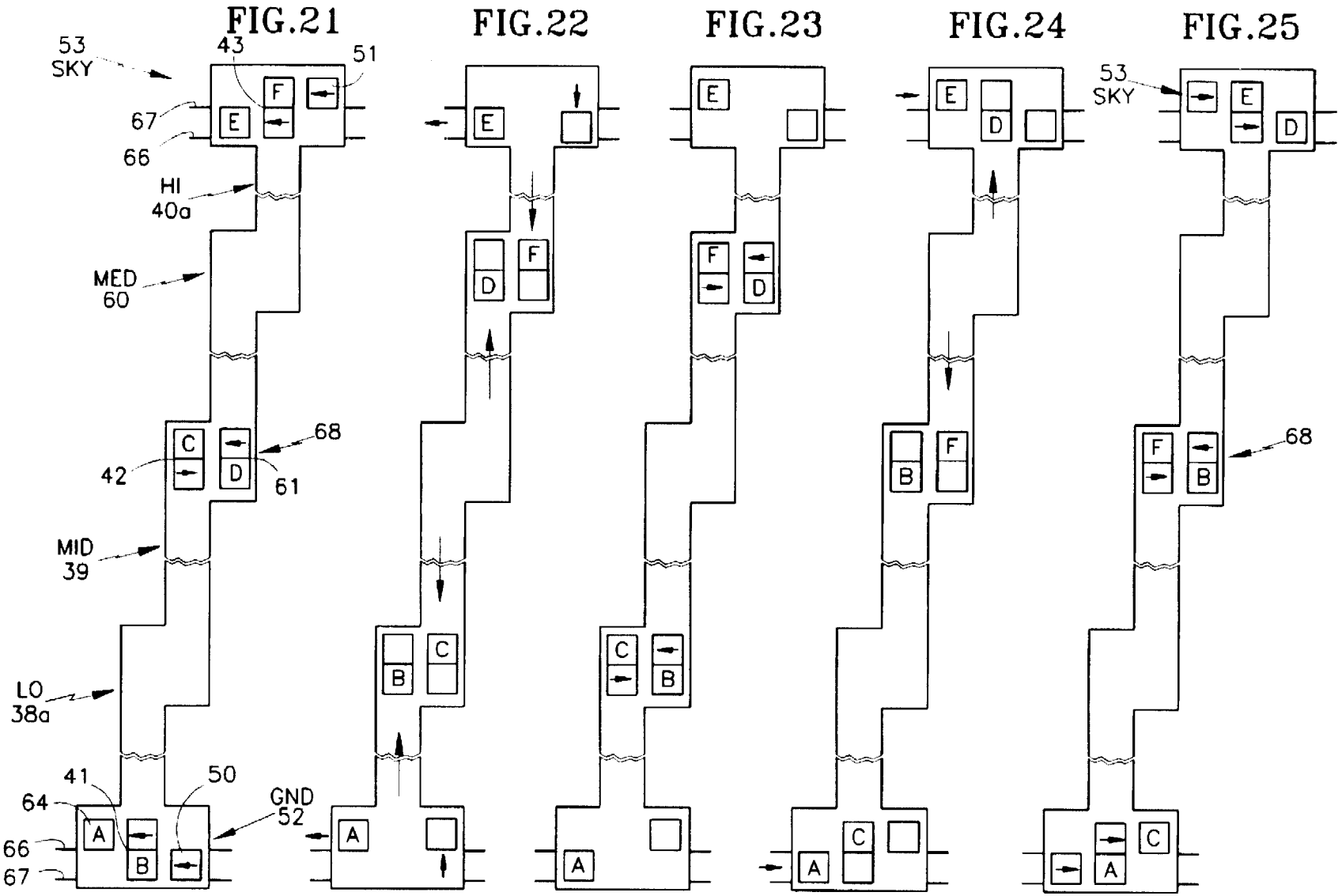
FIGS. 21–30 are stylized, schematic side elevation views of an elevator shuttle having four main hoistways and two auxiliary elevators at each terminal level of the shuttles, whereby movement of cabs in the main hoistways is not delayed by movement in the auxiliary hoistways.
Figures 26, 27, 28, 29, 30:
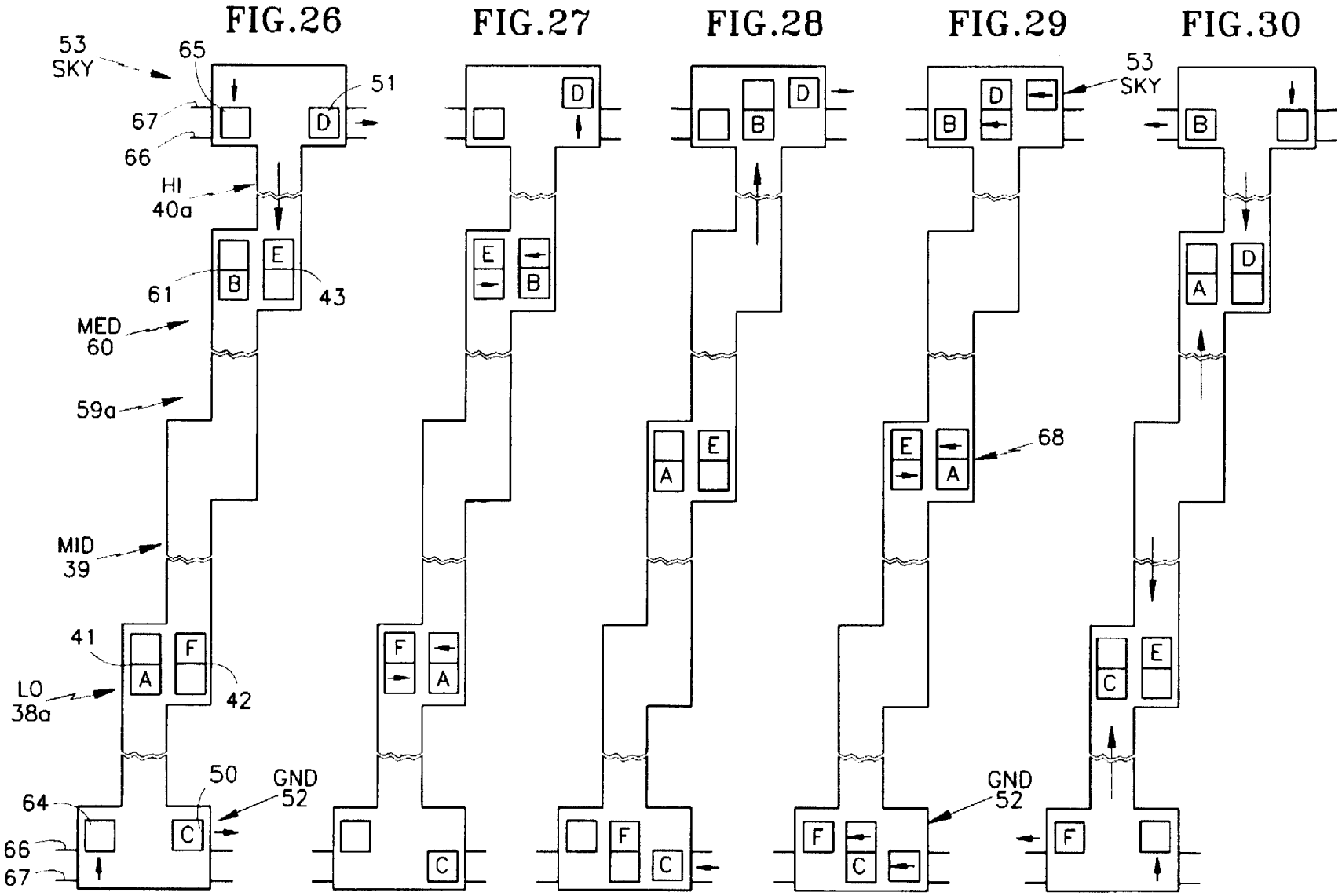

Next, as shown in FIG. 4, cab C will make the downward trip in the upper deck of car frame 41; cab B will begin the upward trip through the mid hoistway 39, in the lower deck of car frame 42; and cab A is moved to the left from the upper auxiliary elevator 51 into the upper deck of car frame 43. In FIG. 5, car frame 43 has reached the low end of its shaft at a second transfer level 57, adjacent to car frame 42; and cab C is moved to the right from car frame 41 into the lower auxiliary elevator 50, and the passengers exit the cab. In FIG. 6, cabs A and B are exchanged at transfer level 57, and cab C moves downwardly in the auxiliary elevator 50 to the lower landing and the passengers enter the cab C. In FIG. 7, the conditions are the same as in FIG. 1, but with different cabs in the various spots. And this process continues as shown in FIGS. 8–10.

Reference to FIGS. 1–10 shows that, in the same time that one of the car frames 41, 43 can move the entire length of its hoistway, the car frame 42 moves only halfway along its hoistway. This is necessitated if one is to cause the car frames 41, 42 (FIG. 2) to arrive adjacent one another simultaneously, and thereafter have the hoistways 42 and 43 arrive to be adjacent one another simultaneously (FIG. 5) while at the same time the cabs at the terminal levels (ground and sky) must exit the main hoistway car frame (41 or 43), be loaded onto an auxiliary elevator (50 or 51), and thereafter raised or lowered in the auxiliary elevator, and also provide for exiting and entering of passengers. Therefore, the roundtrip time from a transfer level, 56 or 57, back to that transfer level, for either of the car frames 41, 43, is necessarily much greater than the time simply to traverse upwardly and downwardly within its hoistway 38, 40. In fact, the amount of time that a car frame 41, 43 is standing at a terminal level (ground or sky), may be on the order of 60–100 seconds, depending upon the manner in which the present invention is implemented. Thus, the middle car frame 39 may either run in a longer hoistway 39, or at a slower speed.

The timing problem also exists in shuttle systems having more than three hoistways, as can be seen in FIGS. 11–20. Therein, a shuttle system 59 includes the low, mid and high hoistways 38–40 along with an additional, medium hoistway 60 having a double decker car frame 61. For example, if cabs A and B were to be brought side-by-side in FIG. 14 instead of only halfway along their respective hoistways, then cabs A and B could be exchanged in FIG. 15 rather than in FIG. 16. And cabs A and B could make their upward and downward trips in FIG. 16, but cabs D and C would not be available for exchange therewith until FIG. 18. This further illustrates the length of time required at the terminal levels 52, 53 of the shuttle, which is not required for traverse of any of the median hoistways 39, 60.

In the embodiment of FIGS. 21–30, a shuttle system **59*a* has the additional medium hoistway 60 with a double deck car frame 61 therein. The ground level 52 and sky level 53 each have an additional auxiliary elevator 64, 65 traversing between upper and lower landings 66, 67. As is seen, particularly in FIGS. 21, 25 and 29, the elevator cabs are exchanged in the same time frame at the terminal levels 52, 53 as they are between the mid car frame 42 and the medium car frame 61 at a central transfer level 68. Thus the run time in each of the hoistways 38*a*, 39, 60 and 40*a*** can be the same, if desired.

In operation, it is assumed that each elevator cab will be locked down to the car frame in which it is riding by cab/car locks, which may be of the type disclosed in commonly owned, copending U.S. patent application Ser. No. 08/565,658, filed Nov. 29, 1995. When the car frames are at either the terminal levels or the transfer levels, it is assumed that each car frame is locked to the building by means of car/floor locks which may be of the type disclosed in commonly owned copending U.S. patent application Ser. No. 08/565,648, filed on Nov. 29, 1995. And, control over all of the cab transfers may be accomplished utilizing the principles disclosed in the aforementioned application Ser. No. 08/564,703 and in commonly owned copending U.S. patent applications filed on Nov. 29, 1995, Ser. Nos. 08/564,534 and 08/565,606.

The best mode for transferring a cab between car frames 41–43 61 as well as between car frames 41, 45 and auxiliary elevators 50, 51 might be a horizontal motive means of the type disclosed in commonly owned U.S. patent application Ser. No. 08/564,704, filed Nov. 29, 1995, described briefly with respect to FIG. 31, as it may appertain to FIG. 2.

Figure 31:
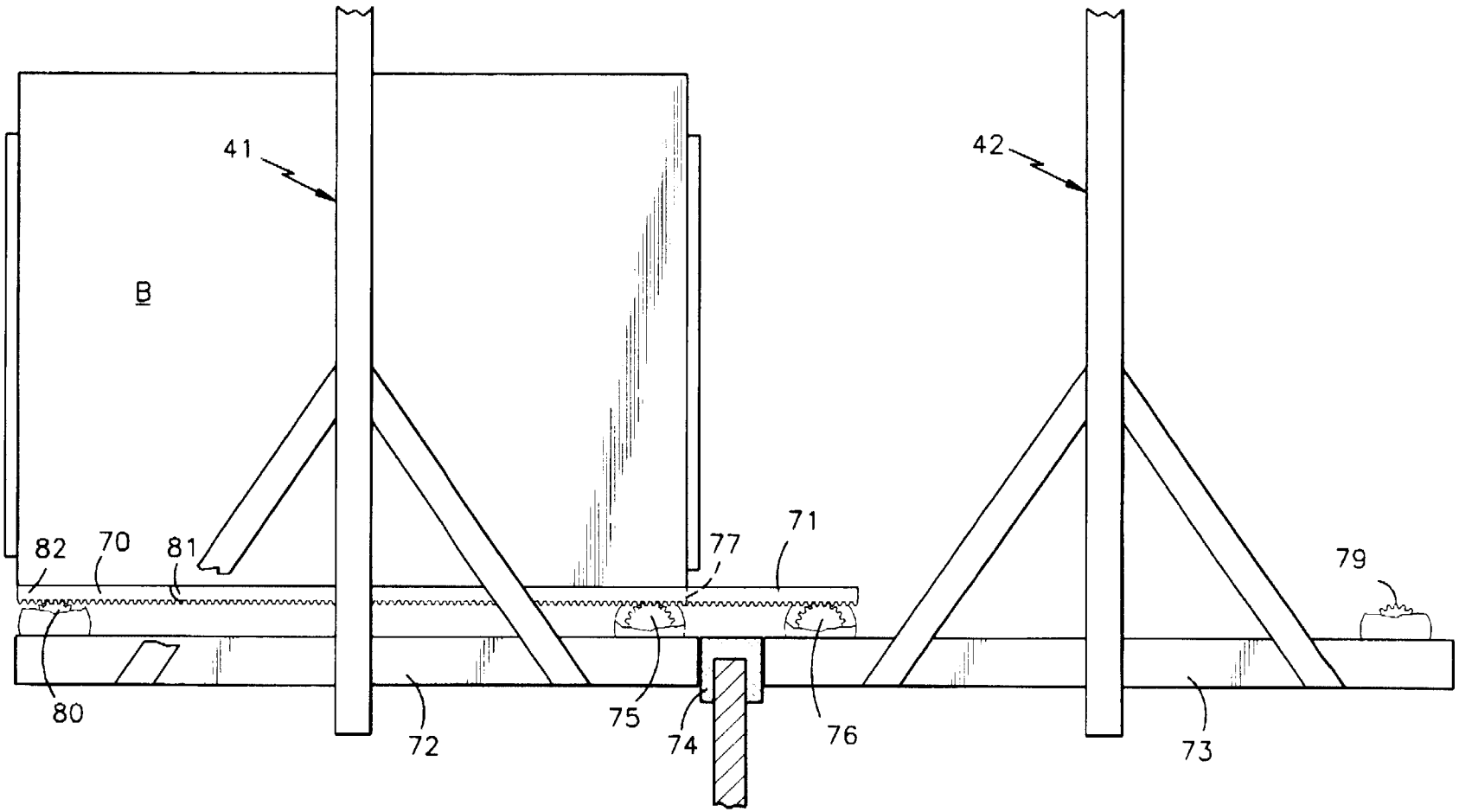
FIG. 31 is a partial, partially broken away, stylized, side elevation view of car frames and horizontal cab motion means.

In FIG. 31, the bottom of the cab B has a fixed, main rack 70 extending from front to back (right to left in FIG. 31), and a sliding rack 71 that can slide outwardly to the right, as shown, or to the left. There are a total of four motorized pinions on each lower deck platform 72, 73 (as well as on each upper deck platform, not shown in FIG. 31) of the car frames 41, 42. First, an auxiliary motorized pinion 75 turns clockwise to drive the sliding auxiliary rack 71 out from under the cab into the position shown, where it can engage an auxiliary motorized pinion 76 on the platform 73, which is the limit that the rack 71 can slide. Then, the auxiliary motorized pinion 76 will turn clockwise pulling the auxiliary rack 71 (which now is extended to its limit) and therefore the entire cab B to the right, over a sill 74, as seen in FIG. 31 until such time as an end 77 of the main rack 70 engages a main motorized pinion (not shown) which is located just behind the auxiliary motorized pinion 76 in FIG. 31. Then, that main motorized pinion will pull the entire cab B fully onto the platform 73 by means of the main rack 70, and as it does so, a spring causes the sliding auxiliary rack 71 to retract under the cab B. An auxiliary motorized pinion 79 can assist in moving the cab B to the right to the car frame 43. Similarly, an auxiliary pinion 80, similar to pinion 76, could assist in moving a cab from a car frame to the left of that shown in FIG. 31, if there were any need.

A transfer from left to right occurs only on the upper decks and between the auxiliary elevators 50, 51 and the car frames 41 and 43. However, for simplicity, it is described herein as being between the same lower decks 42, 41. To return the cab B from the platform 73 to the platform 72, the auxiliary pinion 76 will operate counterclockwise, causing the sliding auxiliary rack 71 to move outwardly to the left until its left end 81 engages the auxiliary pinion 75. Then the auxiliary pinion 75 pulls the auxiliary rack 71 and the entire cab B to the left until the left end 82 of the main rack engages a main motorized pinion (not shown) located behind the auxiliary motorized pinion 75, which then pulls the entire cab B to the left until it is fully on the frame 72.

The invention is shown in each of its embodiments herein as having each elevator shaft above another to the right of said other. However, it is obvious that the invention will work with staggered groups of elevator shafts, in which odd number shafts will all be on the same side of even numbered shafts. The invention is shown with the landings to the right in FIGS. 1–20, but they could, obviously, equally well be to the left, or the lower landings could be on one side and the upper landings on the other, without altering the invention.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator shuttle system for providing transportation between a first level of a building and a second level of said building vertically remote from said first level, comprising:

at least three elevator hoistways, the lowermost end of each hoistway except the lowest hoistway overlapping with the uppermost end of another of said hoistways, the uppermost end of each of said hoistways except the uppermost hoistway overlapping with the lowermost end of another one of said hoistways, each hoistway being contiguous with said another one of said hoistways with which it overlaps, the lowermost end of said lowermost hoistway being at one of said terminal levels of said building and the uppermost end of the uppermost one of said hoistways being at the other of said terminal levels of said building;

a main double deck elevator car frame in each of said hoistways, each moveable between the lowermost end and the uppermost end of the corresponding one of said hoistways;

an auxiliary elevator at each of said first and second levels, each of said auxiliary elevators having a car frame with a deck, each car frame moveable between a pair of landings having the same mutual separation as the mutual separation of the decks on said car frames, each of said auxiliary car frames when at one of said corresponding landings, having its deck adjacent to one of the decks of a related main car frame when said related main car frame is at the corresponding end of its hoistway, each of said auxiliary car frames, when at the other of said corresponding landings, having its deck adjacent to the other deck of said related main car frame when said related main car frame is at said corresponding end of its hoistway;

a plurality of elevator cabs moveable between the main car frames of adjacent ones of said hoistways and between said auxiliary car frames and the main car frames of said highest and lowest hoistways, the number of said cabs equalling one elevator cab for each of said hoistways except said highest hoistway and said lowest hoistway and one elevator cab for each of said auxiliary car frames; and means disposed on each of said car frames for moving said cabs between any one of said decks and a deck adjacent thereto.

2. A system according to claim 1, comprising:

a pair of said auxiliary elevators at each of said first and second levels, one on one side of the related hoistway and one on the opposite side of the related hoistway; and an additional pair of cabs;

said mans for moving said cabs between any one of said decks and a deck adjacent thereto moving said cabs substantially simultaneously from one of said auxiliary car frames at one of said levels to an adjacent main car frame and from said adjacent main car frame to the other of said auxiliary car frames at said one of said levels.

3. A method of providing transportation between a first level of a building and a second level of said building vertically remote from said first level, which comprises:

moving an elevator cab from said first level to said second level in the lower decks of a succession of three or more double deck car frames, each moveable in a respectively corresponding one of a plurality of overlapping, contiguous hoistways;

moving said cab from the lower deck of a car frame at said second level into an auxiliary elevator;

raising said cab in said auxiliary elevator to a position adjacent to the upper deck of said car frame at said second level;

moving said cab from said auxiliary elevator into said upper deck of said car frame at said second level; and moving said cab from said second level to said first level in the upper decks of said succession of car frames.

4. A method according to claim 3, comprising:

moving said elevator cab from the upper deck of a car frame at said first level into a second auxiliary elevator at said first level;

lowering said cab in said second auxiliary elevator to a position adjacent to the lower deck of said car frame at said first level; and moving said elevator cab from said second auxiliary elevator into the lower deck of said car frame at said first level.

5. A method according to claim 3 wherein the first one of said moving steps comprises:

moving an elevator cab from a low level of said building to a high level of said building.

6. A method according to claim 3, comprising:

moving at least three elevator cabs simultaneously, one in each of said succession of hoistways.

7. A method according to claim 3, comprising:

moving a second elevator cab from said first level to said second level in the lower decks of said succession of car frames;

moving said second cab from the lower deck of a car frame at said second level into an additional auxiliary elevator disposed on a side of said hoistway at said second level opposite to said first-named auxiliary elevator;

raising said cab in said additional auxiliary elevator to a position adjacent to the upper deck of said car frame at said level;

moving said cab from said additional auxiliary elevator into said upper deck of said car frame at said second level; and moving said cab from said second level to said first level in the upper decks of said succession of car frames.

8. A method according to claim 7, comprising:

moving said second cab from the upper deck of a car frame at said first level into another auxiliary elevator at said first level;

lowering said second cab in said another auxiliary elevator to a position adjacent to the lower deck of said car frame at said first level; and moving said second cab from said another auxiliary elevator into the lower deck of said car frame at said first level.

* * * * *